US011852987B2

(12) United States Patent
Takeda et al.

(10) Patent No.: US 11,852,987 B2
(45) Date of Patent: Dec. 26, 2023

(54) IMAGE FORMING APPARATUS

(71) Applicant: CANON KABUSHIKI KAISHA, Tokyo (JP)

(72) Inventors: Isamu Takeda, Tokyo (JP); Takanori Mitani, Kanagawa (JP); Satoshi Nishida, Kanagawa (JP); Takao Kume, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/956,196

(22) Filed: Sep. 29, 2022

(65) Prior Publication Data

US 2023/0101599 A1 Mar. 30, 2023

(30) Foreign Application Priority Data

Sep. 30, 2021 (JP) ..... 2021-161022

(51) Int. Cl.
*G03G 15/02* (2006.01)

(52) U.S. Cl.
CPC ..... *G03G 15/0266* (2013.01)

(58) Field of Classification Search
CPC ..... G03G 15/0266; G03G 15/043; G03G 2215/043
USPC ..... 399/50, 51, 174
See application file for complete search history.

(56) References Cited

U.S. PATENT DOCUMENTS

| | | | | |
|---|---|---|---|---|
| 9,001,174 | B2 | 4/2015 | Katagiri et al. | |
| 9,268,252 | B2 * | 2/2016 | Shoji | G03G 15/043 |
| 9,599,923 | B2 | 3/2017 | Kitamura et al. | |
| 10,788,769 | B2 | 9/2020 | Katagiri et al. | |

FOREIGN PATENT DOCUMENTS

| | | | |
|---|---|---|---|
| JP | 2008-008991 | A | 1/2008 |
| JP | 2013-214047 | A | 10/2013 |
| JP | 2014-123017 | A | 7/2014 |
| JP | 2019-074700 | A | 5/2019 |

* cited by examiner

*Primary Examiner* — Hoan H Tran
(74) *Attorney, Agent, or Firm* — Venable LLP

(57) ABSTRACT

An image forming apparatus includes a rotatable photosensitive member, a charging member, an exposing unit to form an electrostatic latent image by exposing the surface of the photosensitive member charged by the charging member to light and, a developing member to develop the electrostatic latent image with toner. A controller controls so that a predetermined charging voltage is charged and the light is emitted by a low light quantity to a first non-print area, which is a non-print area provided in a region including the print area and the first non-print area with respect to a main scanning direction, and controls so that a charging voltage lower than the predetermined voltage is charged and exposure is not performed on a second non-print area, which is provided in a region including only the non-print area with respect to the main scanning direction.

10 Claims, 9 Drawing Sheets

IMAGE FORMING APPARATUS

FIELD OF THE INVENTION

The present invention relates to an image forming apparatus of the electrophotographic type, such as a copier or printer.

FIELD OF THE INVENTION AND RELATED ART

In a conventional electrophotographic image forming apparatus, a contact charging unit is used as a charging means to uniformly charge a photosensitive member, which is an image bearing member, to a predetermined polarity and potential, and has the advantages of low ozone and low power consumption. A contact charging unit is a charging unit that charges the photosensitive member by applying a voltage to a charging member in contact with the photosensitive member. In particular, roller charging contact charging units that use a charging roller (conductive roller) as the charging member are widely used because of their charging stability. There are two methods of applying a charging voltage to the charging roller: an AC charging method in which a superimposed voltage of DC voltage (direct current voltage) and AC voltage (alternating current voltage) is applied, and a DC charging method in which only DC voltage is applied. In recent years, the DC charging method has been used due to its lower cost and space saving.

However, in the DC charging method, it is difficult to achieve uniformity in the photosensitive member after transfer, and the potential irregularities may appear as image defects (also called transfer memory). During the transfer of the toner image from the photosensitive member to a recording medium (recording material or secondary transfer material), the amount of transfer current flowing into the photosensitive member differs between areas with and without toner on the surface of the photosensitive member, resulting in an uneven potential on the photosensitive member after transfer. The uneven potential on the photosensitive member then appears as image defects in the image as it is because the electric potential on the photosensitive member cannot be sufficiently uniform in the next process of the image forming process, the charging process. Therefore, in the past, photoionization (full surface eraser exposure) using a potential irregularity removal method has been used to equalize the potential of the photosensitive member surface after transfer, but installing a potential irregularity removal method causes the apparatus to become larger in size and more costly.

Therefore, for example, Japanese Laid-Open Patent Application No. 2008-8991 proposes to use a so-called background exposure as a method to suppress transfer memory without providing a separate means to remove potential irregularities. With background exposure, the exposure means exposes the photosensitive member, which has been charged to a predetermined potential in the charging process, to the printing area where the toner image is formed, and also exposes the non-printing area where the toner image is not formed at a weak light intensity. However, when a photosensitive member is exposed to light exceeding a certain light intensity, a phenomenon called "optical fatigue" appears, such as a decrease in the charging potential due to the effect of the exposure. Therefore, in a method such as described in Japanese Laid-Open Patent Application No. 2008-8991, where the photosensitive member surface is constantly exposed to light, it was necessary to take into consideration the decrease in sensitivity due to the optical fatigue of the photosensitive member. Accordingly, for example, in Japanese Laid-Open Patent Application No. 2014-123017, an exposure control is proposed in which background exposure is not performed or laser power is reduced in non-image forming areas except for image forming areas where images are formed to be transferred onto the recording material.

In recent years, however, there has been a growing demand for longer product life and higher image quality. Therefore, in order to achieve further product lifespan extension, it has become a challenge to reduce the optical fatigue of photosensitive members as much as possible and to suppress the decrease in photosensitive sensitivity of photosensitive members.

SUMMARY OF THE INVENTION

The purpose of the present invention is to reduce the amount of exposure to photosensitive members while maintaining image quality.

In order to solve the above-mentioned problem, the present invention has the following configuration. An image forming apparatus includes a rotatable photosensitive member; a charging member configured to charge a surface of the photosensitive member; an exposing unit configured to form an electrostatic latent image by exposing the surface of the photosensitive member charged by the charging member to light; a developing member configured to develop the electrostatic latent image with toner; a power supplying portion configured to apply a charging voltage to the charging member; and a controller configured to control the exposing unit and the power supplying portion, wherein, of an area of the photosensitive member corresponding to a recording material on which image forming is performed, the controller controls so that a light is emitted by a first light quantity to a print area, of the photosensitive member, on which the electrostatic latent image is developed with the toner, and the light is emitted by a second light quantity smaller than the first light quantity to a non-print area on which the electrostatic latent image is not formed, and wherein the controller controls so that a predetermined charging voltage is charged and the light is emitted by the second light quantity to a first non-print area which is a non-print area provided with the print area and the non-print area with respect to a main scanning direction which is a rotational axis direction of the photosensitive member, and controls so that a charging voltage which is the same polarity as the predetermined charging voltage and of which an absolute value is smaller than the absolute value of the predetermined voltage is charged and exposure is not performed to a second non-print area which is provided with only the non-print area with respect to the main scanning direction of the photosensitive member.

In order to solve the above-mentioned problem, the present invention has the following other configuration. An image forming apparatus includes a rotatable photosensitive member; a charging member configured to charge a surface of the photosensitive member; an exposing unit configured to form an electrostatic latent image by exposing the surface of the photosensitive member charged by the charging member to light; a developing member configured to develop the electrostatic latent image with toner; a power supplying portion configured to apply a charging voltage to the charging member; and a controller configured to control the exposing unit and the power supplying portion, wherein, of an area of the photosensitive member corresponding to a recording material on which image forming is performed, the controller controls so that a light is emitted by a first light quantity to a print area, of the photosensitive member, on which the electrostatic latent image is developed with the toner, and the light is emitted by a second light quantity smaller than the first light quantity to a non-print area on which the electrostatic latent image is not formed, and wherein the controller controls so that a predetermined charging voltage is charged and the light is emitted by the second light quantity to a first non-print area which is a non-print area provided with the print area and the non-print area with respect to a main scanning direction which is a rotational axis direction of the photosensitive member, and controls so that the predetermined charging voltage is charged and the light is emitted by a third light quantity smaller than the second light quantity to a second non-print area which is provided with only the non-print area with respect to the main scanning direction of the photosensitive member.

Further features of the present invention will become apparent from the following description of exemplary embodiments (with reference to the attached drawings).

Figure 3:
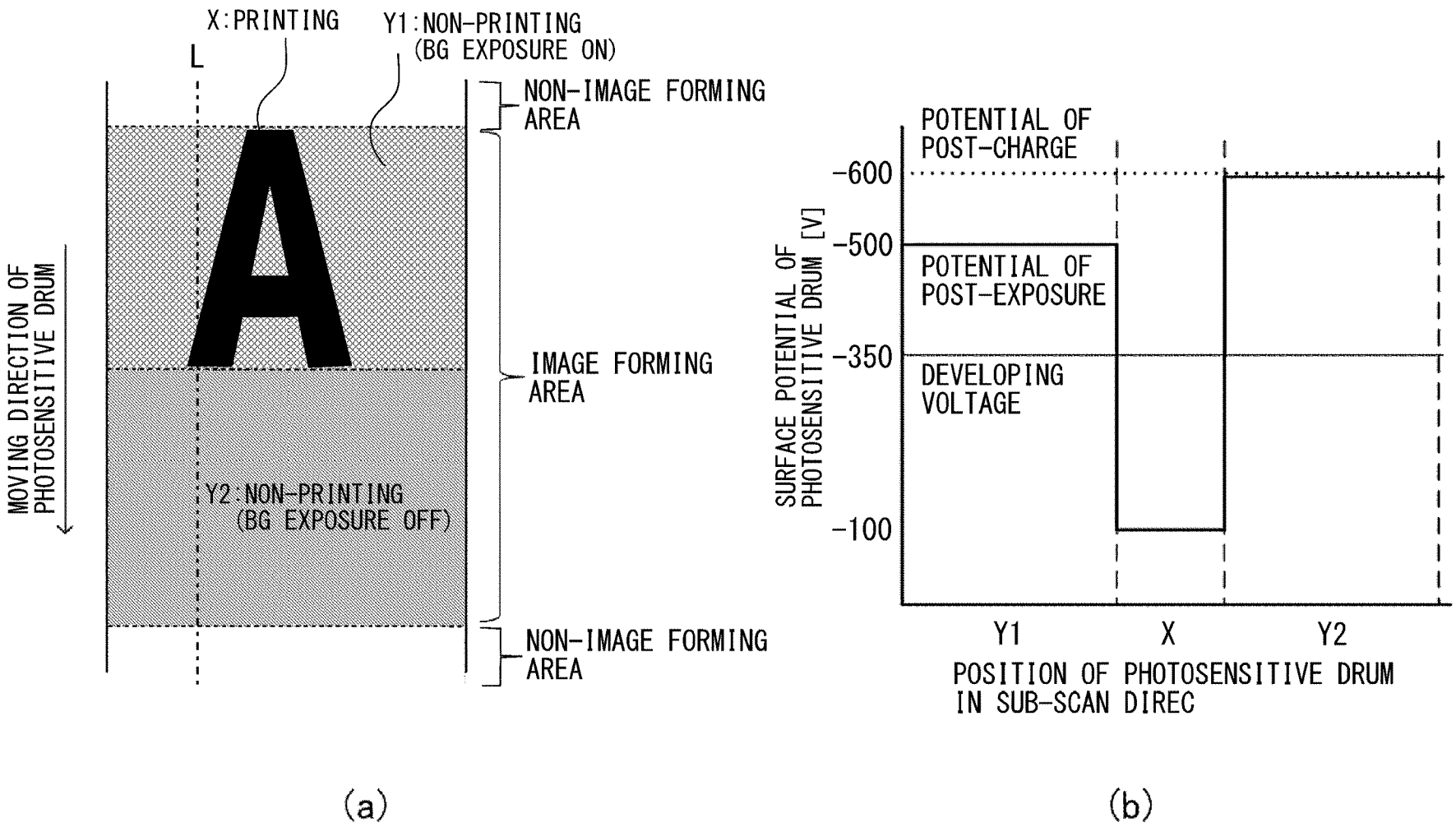

Part (a) of FIG. 3 is a schematic drawing showing the printing and non-printing portions on the photosensitive drum surface in Embodiment 1, and Part (b) of FIG. 3 is a graph showing the potential of the photosensitive drum surface when exposure control is applied.

Figure 4:
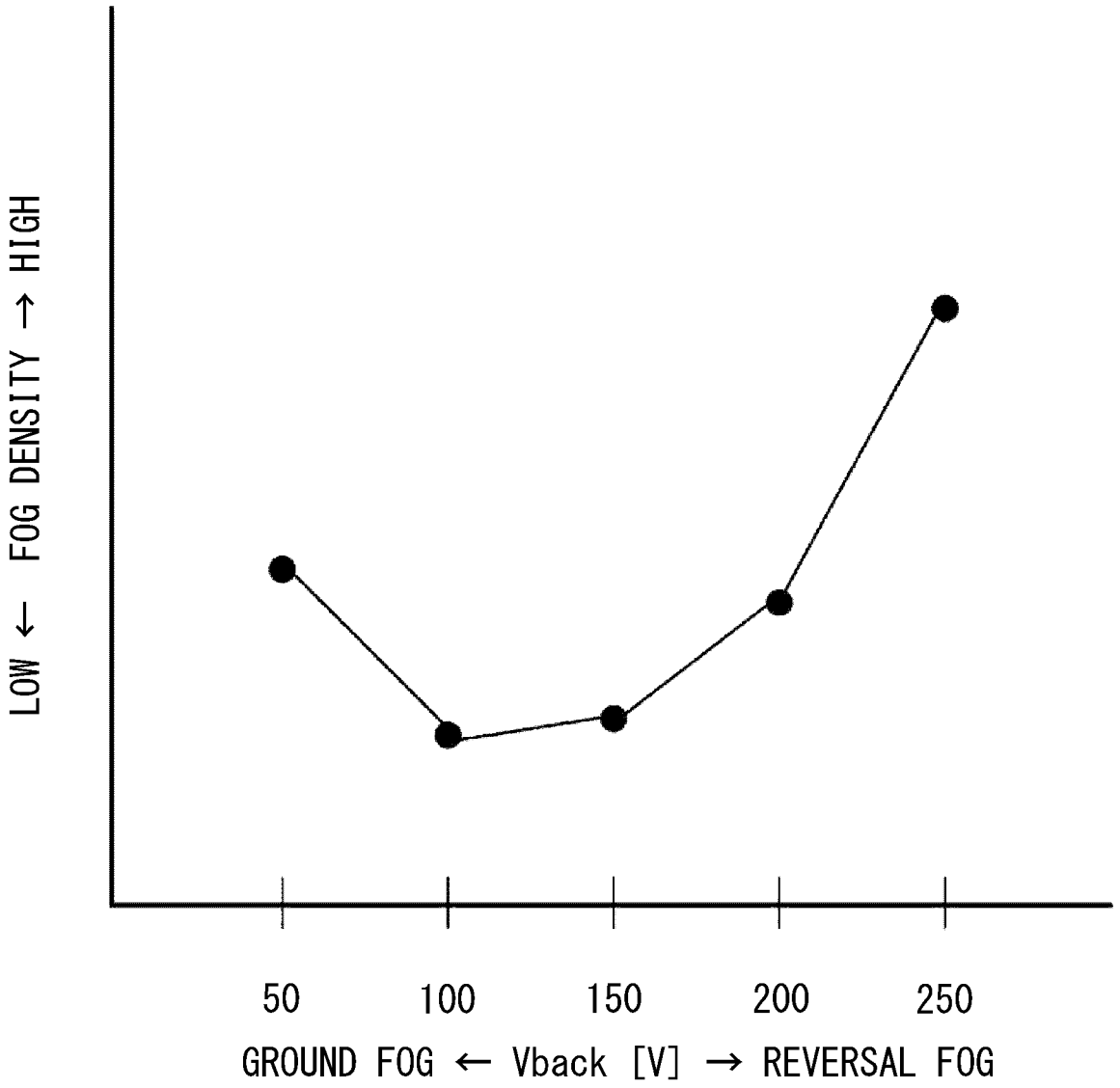

FIG. 4 is a graph showing the relationship between back contrast and fogging toner concentration for Embodiments 1 and 2.

Figure 5:
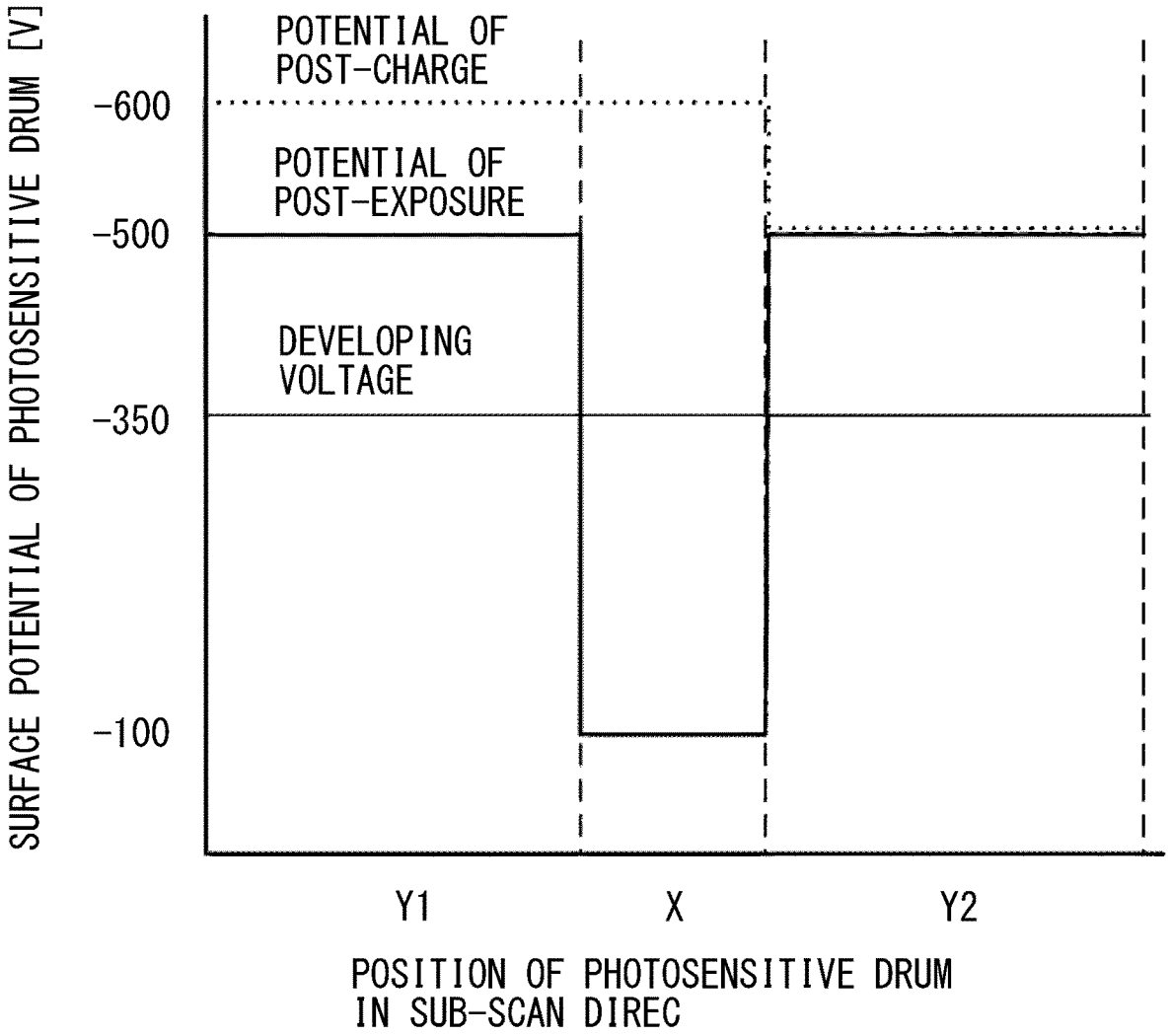

FIG. 5 is a drawing showing a potential on the surface of the photosensitive drum when the exposure control and charging control of Embodiment 1 are implemented.

Figure 6:
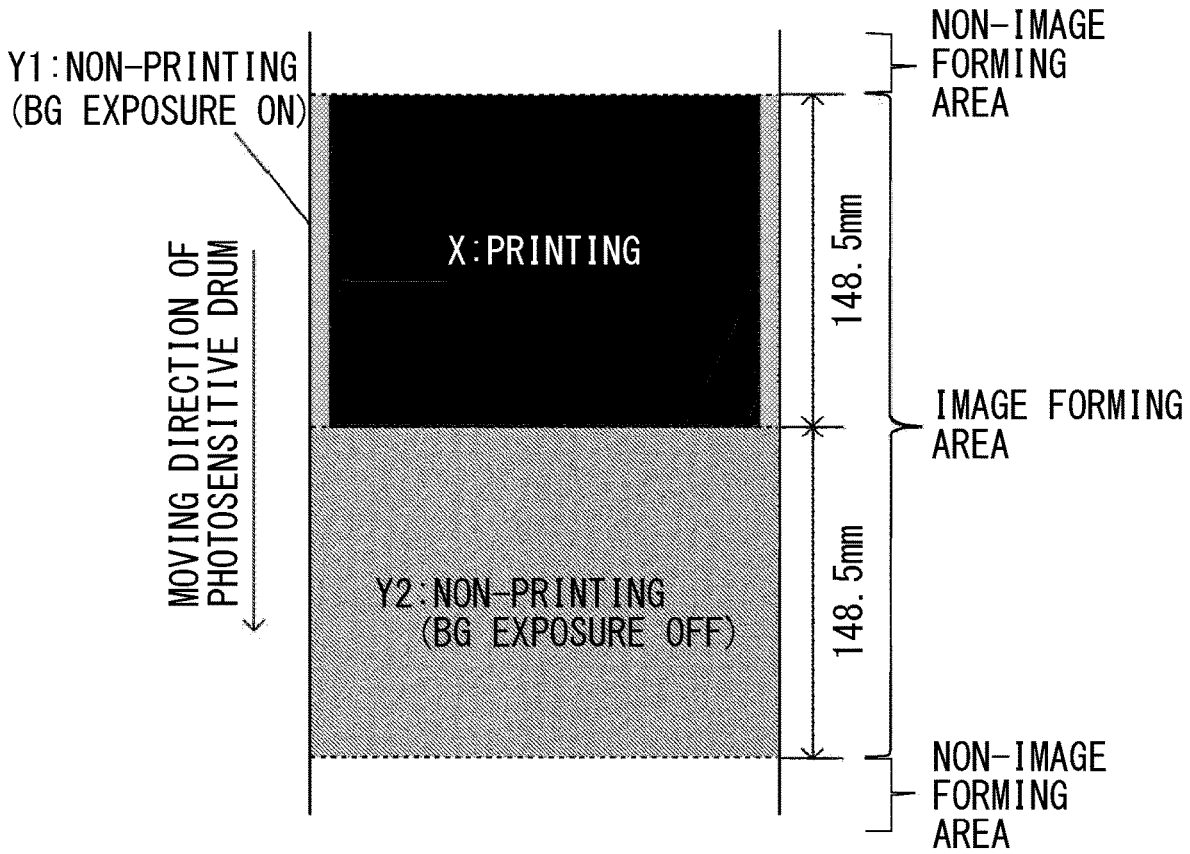

FIG. 6 is a schematic drawing showing the image data used in the experiment in Embodiment 1.

Figure 7:
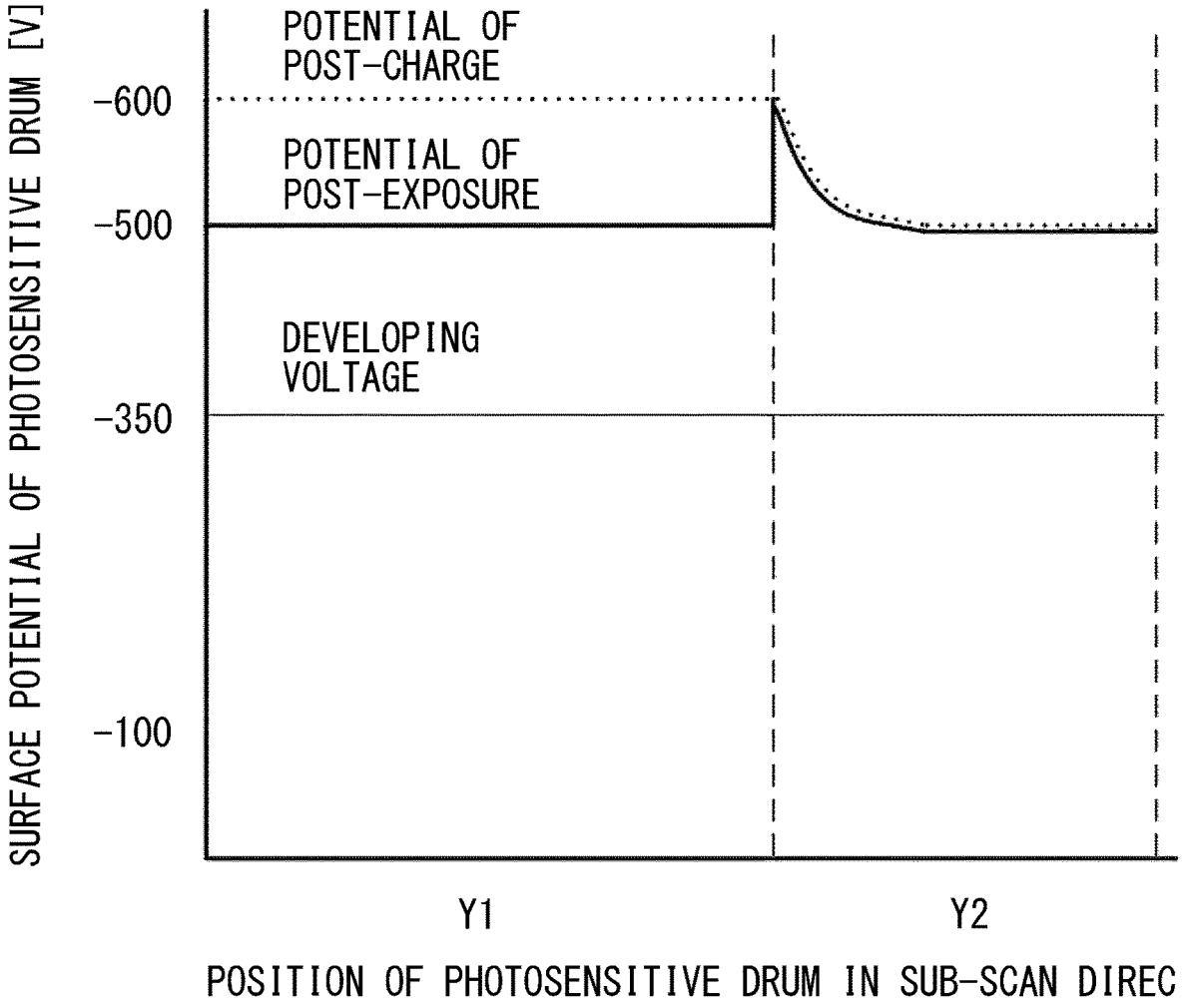

FIG. 7 is a drawing showing a potential on the surface of the photosensitive drum when switching to the non-printing portion of Embodiment 1.

Figure 8:
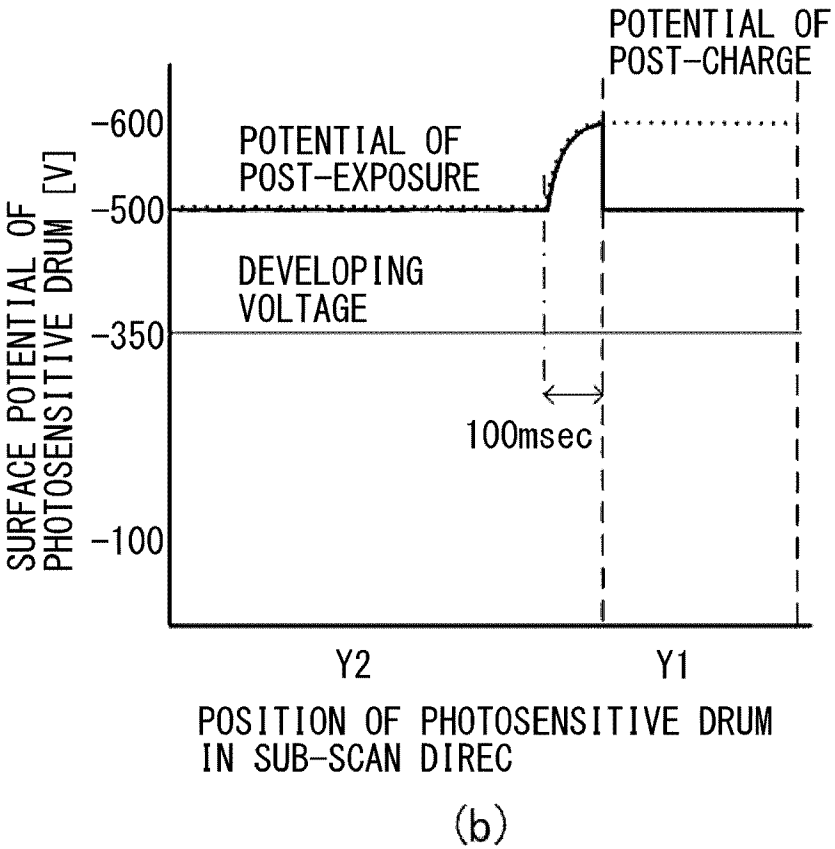
Figure 8:
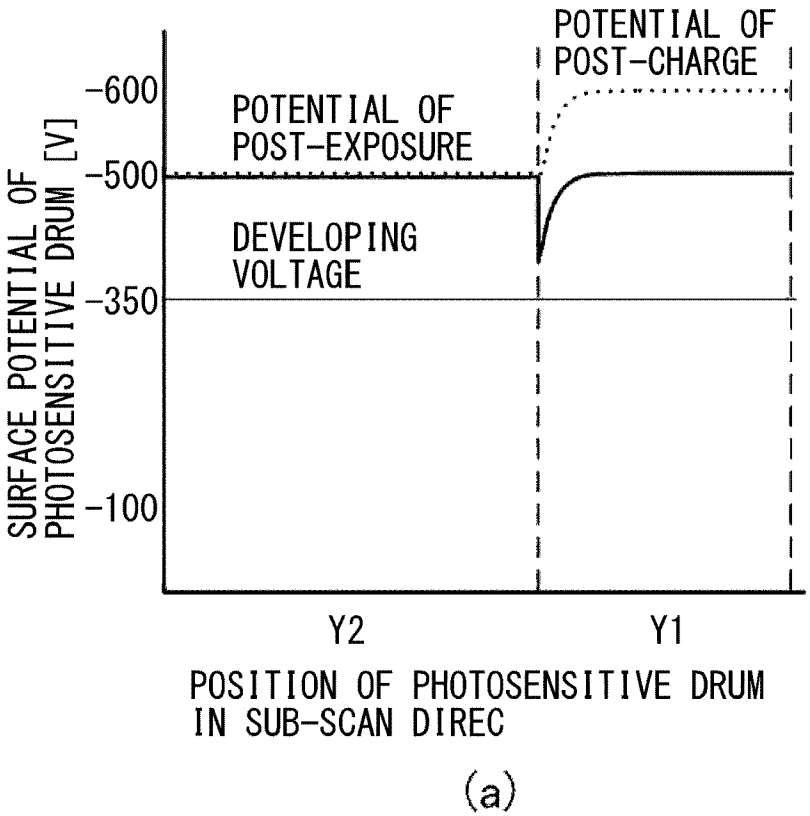

FIG. 8, part (a) and part (b), is a graph showing a potential on the surface of the photosensitive drum when the charging control switching timing is changed when switching to the non-printing portion in Embodiment 2.

Figure 9:
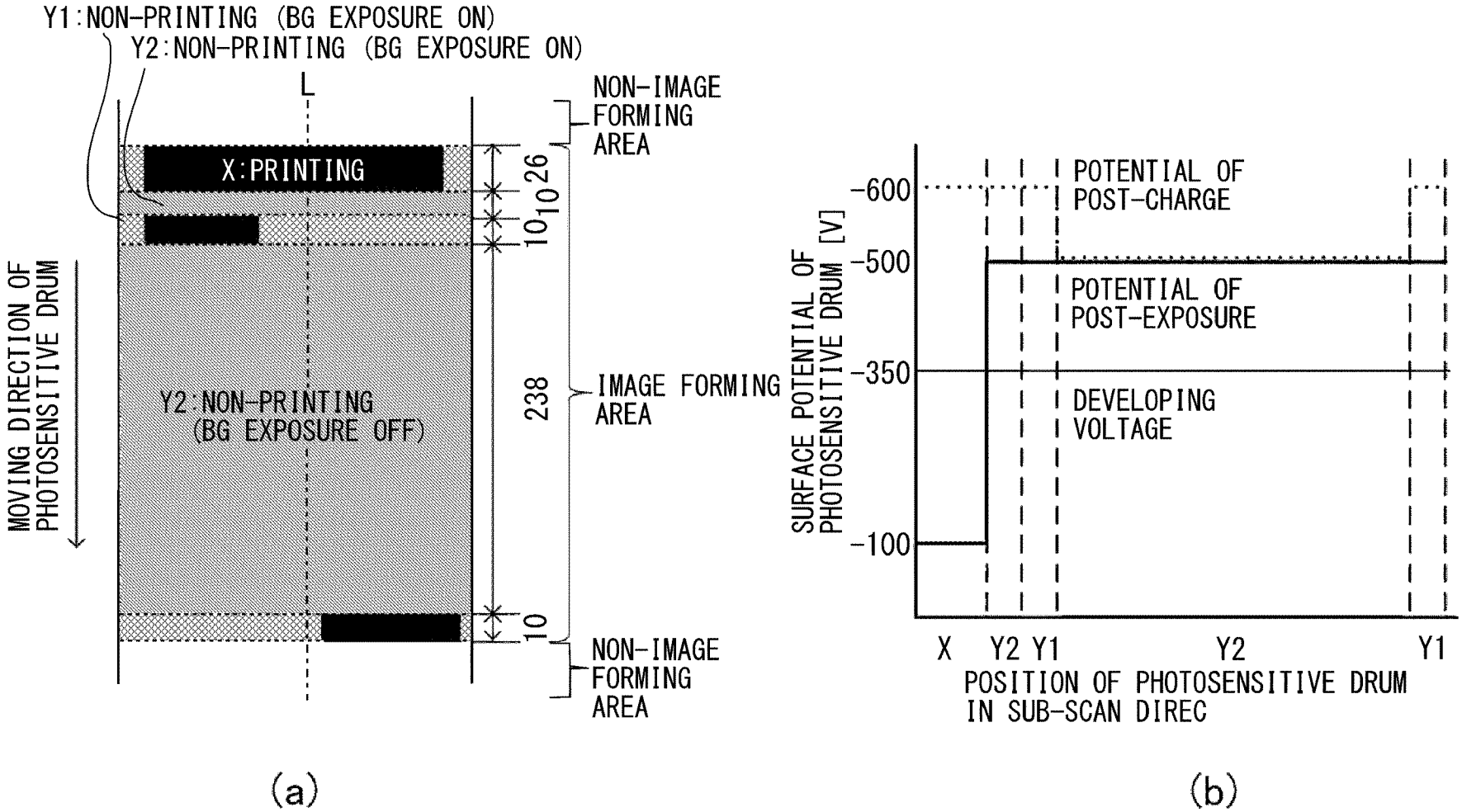

Part (a) of FIG. 9 is a schematic drawing representing the image data used in an experiment in Embodiment 2, and Part (b) of FIG. 9 is a graph showing the potential of the photosensitive drum surface.

DESCRIPTION OF THE EMBODIMENTS

The following is a detailed description of the embodiments of the present invention with reference to the drawings.

[Image Forming Apparatus Configuration]

Figure 1:
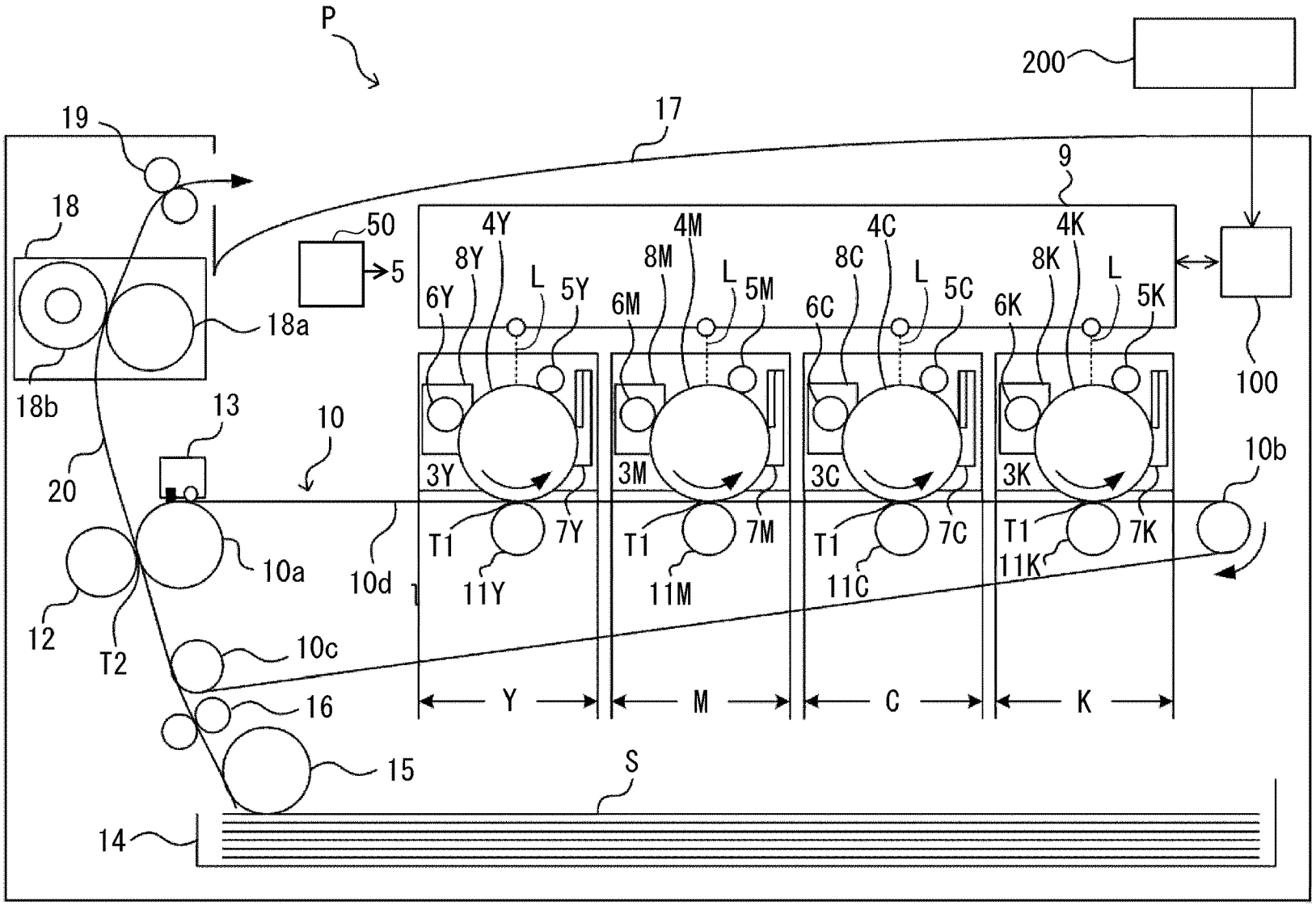
FIG. 1 is a cross-sectional drawing showing a schematic configuration of the image forming apparatus of Embodiments 1 and 2.

FIG. 1 is a cross-sectional schematic drawing showing a configuration example of an image forming apparatus P to be used in Embodiment 1. The image forming apparatus P is a color laser beam printer of the intermediate transfer type with four image forming stations Y, M, C, and K. The four image forming stations Y, M, C, and K are image forming portions that form toner images using yellow, magenta, cyan, and black toner, respectively. As shown in FIG. 1, each image forming station Y, M, C, and K is arranged in parallel inside the image forming apparatus P at fixed intervals from left to right in the figure. Each image forming station is configured as a process cartridge 3 (3Y, 3M, 3C, 3K) whose main part is removable to a predetermined mounting portion of the main body of the image forming apparatus P.

Each process cartridge 3 (3Y, 3M, 3C, 3K) has the same configuration, although the color of the developer (toner) contained in each is different. The Y, M, C, and K given at the end of the codes in FIG. 1 indicate that the member is a member of an image forming station Y, M, C, or K. In the following description, the Y, M, C, and K at the end of the codes are omitted unless the member indicates that the member is a member of a specific image forming station.

In the present embodiment, each process cartridge 3 has a rotating drum-type photosensitive drum 4 as an image bearing member. Each process cartridge 3 has a charging roller 5 that charges the photosensitive drum 4 to a predetermined potential, a developing roller 6 that is a developing member that develops the electrostatic latent image on the photosensitive drum 4 (on the photosensitive member) with toner, and a cleaning portion 7 that removes toner from the photosensitive drum 4. The charging roller 5 is positioned opposite to the photosensitive drum 4, making contact with the photosensitive drum 4 and charging the surface of the photosensitive drum 4 to a uniform potential. The developing device visualizes the electrostatic latent image formed on the photosensitive drum 4 with a developer (toner), and has a developer container 8 containing the developer and a developing roller 6 positioned opposite to the photosensitive drum 4. The developing device in the present embodiment is a one-component contact developing device and uses a non-magnetic one-component toner (negative charge characteristics) as the developer. A developer container 8Y of the process cartridge 3Y contains yellow (Y) toner as a developer, and a developer container 8M of the process cartridge 3M contains magenta (M) toner as a developer. Similarly, a developer container 8C of the process cartridge 3C contains cyan (C) toner as a developer, and a developer container 8K of the process cartridge 3K contains black (K) toner as a developer. The cleaning portion 7 is a cleaner that cleans the toner that remains on the surface of the photosensitive drum 4 without being transferred after the toner image formed on the photosensitive drum 4 is transferred to an intermediate transfer belt 10*d*, which is described later, and in the present embodiment uses a blade as a cleaning member.

The photosensitive drum 4 is driven by a driving portion (not shown) installed in the main body of the image forming apparatus P in the direction of the arrow in the Figure (counterclockwise direction) at a surface moving speed (process speed) of 150 mm/second. The photosensitive drum 4 is an aluminum cylinder with an outer diameter of 20 mm, which is the base material, coated with a thin film of a charge generation layer and a charge transporting layer, and the aluminum cylinder is grounded.

The charging roller 5, which is the charging means and charging member, has a metal core and a conductive portion of an elastic layer concentrically formed around the metal core, and both ends of the metal core are rotatably supported on bearings. The charging roller 5 is arranged parallel to the photosensitive drum 4, and the conductive elastic layer is in contact with the photosensitive drum 4 with a predetermined pressing force and rotates in accordance with the rotation of the photosensitive drum 4. In the present embodiment, a DC voltage of about −1000 V is applied to the metal core of the charging roller 5 as the charging voltage from the power supply portion 50 installed in the main body of the image forming apparatus P.

The developing roller 6, which is a developing means, has a metal core and a conductive elastic layer formed concentrically and integrally around the metal core. The developing roller 6 is arranged parallel to the photosensitive drum 4 and is driven by a driving portion (not shown) installed in the main body of the image forming apparatus P at a predetermined surface moving speed. The developing roller 6 bears and transfers negatively polarity charged toner (developer) to a developing position opposite to the photosensitive drum 4. In the present embodiment, a DC voltage of about −350 V is applied to the core metal of the developing roller 6 as the developing voltage from a power supply portion (not shown) installed in the main body of the image forming apparatus P.

As shown in FIG. 1, a laser exposure unit 9, which is an exposure means (exposure unit) that exposes the photosensitive drum 4 of each process cartridge 3, is provided at the top of the image forming stations Y, M, C, K. A printer controller 200, which makes a print request to the image forming apparatus P, sends a print request signal including image information to a video controller (control portion) 100 in the image forming apparatus P. The video controller 100 converts the image information received together with the print request signal received from the printer controller 200 into an image-processed video signal and outputs it to the laser exposure unit 9. The laser exposure unit 9 outputs a laser beam L (called normal light emission) from a laser output portion that has a laser element, with the light quantity (first light quantity) modulated according to the video signal input from the video controller 100. The output laser beam L scans the photosensitive drum 4 of each process cartridge 3 in the longitudinal direction (depth direction in FIG. 1), forming an electrostatic latent image on the surface of the photosensitive drum 4 in response to image information. The electrostatic latent image formed on the photosensitive drum 4 is developed by the developing roller 6 by adhering (supplying) toner to form a toner image, which is a visible image.

As shown in FIG. 1, an intermediate transfer belt unit 10 is located below the image forming stations Y, M, C, and K. The intermediate transfer belt unit 10 has a secondary transfer opposing roller 10*a*, a driving roller 10*b*, a suspension roller 10*c*, and an intermediate transfer belt 10*d* suspended between each roller. The intermediate transfer belt 10*d* is made of resin film in an endless form. The resin films are PVdf (polyvinylidene fluoride), nylon, PET (polyethylene terephthalate), PC (polycarbonate), etc. with electrical resistivity (volume resistivity) of about 10E+11 to 10E+16 (Q-cm) and thickness of 100 to 200 m. The intermediate transfer belt 10*d* is driven at a predetermined process speed (a predetermined speed corresponding to the surface moving speed of the photosensitive drum 4) when the driving roller 10*b* is driven by the driving portion (not shown) in a clockwise direction.

As shown in FIG. 1, primary transfer rollers 11 corresponding to the photosensitive drums 4 of each process cartridge 3 are located on the inside of the intermediate transfer belt 10*d*. The primary transfer rollers 11 are each arranged opposite to the corresponding photosensitive drum 4 and are in contact with the lower part of the photosensitive drum 4 via the intermediate transfer belt 10*d* with a predetermined pressing force. In each image forming station Y, M, C, and K, the contact portion between the photosensitive drum 4 and the intermediate transfer belt 10*d* is referred to as a primary transfer position T1. A DC voltage of positive polarity is applied to the shaft of each primary transfer roller 11 from a power supply portion (not shown) as a primary transfer voltage, and the toner image formed on the photosensitive drum 4 is transferred to the intermediate transfer belt 10*d*.

A secondary transfer opposing roller 12 is arranged opposite to the secondary transfer roller 10*a* via the intermediate transfer belt 10*d* and is held in place with appropriate pressure. The contact portion between the secondary transfer roller 12 and the intermediate transfer belt 10*d* is referred to as a secondary transfer position T2. A positive polarity DC voltage is applied to the shaft of the secondary transfer roller 12 from a power supply portion (not shown) as a secondary transfer voltage, and the toner image formed on the intermediate transfer belt 10*d* is transferred onto the recording material passing through the secondary transfer position T2. In a belt suspending portion of the secondary transfer opposing roller 10*a*, a belt cleaner 13 is located downstream of the secondary transfer position T2 in the rotational direction of the intermediate transfer belt 10*d* to remove toner remaining on the intermediate transfer belt 10*d* that has not been transferred onto the recording material.

As shown in FIG. 1, the image forming apparatus P has a cassette 14 in which recording materials S, the recording medium, are stored below the intermediate transfer belt unit 10. The image forming apparatus P also has a pickup roller 15 that feeds out recording materials S from the cassette 14 one sheet at a time, and a resist roller pair 16 that controls the timing of feeding control of the recording materials S fed from the pickup roller 15 to the secondary transfer position T2. As shown in FIG. 1, on the left side of the Figure in the main body of the image forming apparatus P, there is arranged a feeding path 20 along which the recording material S fed from the cassette 14 is fed to a discharging tray 17 provided at the top of the image forming apparatus P. In the feeding path 20, the resist roller pair 16, the secondary transfer roller 12, the fixing unit 18, and the discharging roller pair 19 are arranged from upstream to downstream in the feeding path of the recording material S. The fixing unit 18 has a fixing roller 18*a* heated by a fixing heater that heats the recording material S on which the toner image has been transferred, and a pressure roller 18*b* that contacts the fixing roller 18*a* and presses the recording material S passing through it with a predetermined pressure.

[Image Forming Operation]

Next, the image forming operation of the image forming apparatus P is explained. When the video controller 100 receives a print request signal from the printer controller 200, it starts operating the driving portions (not shown) that rotate and drive the photosensitive drum 4, intermediate transfer belt 10*d*, etc. of each process cartridge 3 to begin image forming. When the photosensitive drum 4 starts rotating, the surface of the photosensitive drum 4 is charged to a uniform potential by a charging roller 5 to which a charging voltage is applied. When the surface of the photosensitive drum 4 charged to a uniform potential by the charging roller 5 reaches the exposure position by the laser exposure unit 9, a laser beam L corresponding to the image information emitted from the laser element of the laser exposure unit 9 is irradiated onto the surface of the photosensitive drum 4. This forms an electrostatic latent image corresponding to the image information on the surface of the photosensitive drum 4. The electrostatic latent image formed on the surface of the photosensitive drum 4 is developed by the developing roller 6, which is rotating in contact with the photosensitive drum 4 and to which toner is attached to form a visible toner image. The formed toner image is transferred onto the intermediate transfer belt 10*d* by the primary transfer voltage applied to the primary transfer roller 11 at the primary transfer position T1.

During color image forming, the above-mentioned processes are sequentially performed at the four image forming stations Y, M, C, and K. The toner images of multiple colors are superimposed and transferred on the intermediate transfer belt 10*d*. In the present embodiment, the yellow, magenta, cyan, and black toner images formed on each photosensitive drum 4 at the image forming stations Y, M, C, and K are sequentially superimposed and transferred onto the intermediate transfer belt 10*d* to form a color toner image. The toner image formed on the intermediate transfer belt 10*d* is transferred at the secondary transfer position T2 by the secondary transfer roller 12, to which the secondary transfer voltage is applied, to the recording material S fed from the cassette 14 at the specified timing.

The recording material S onto which the toner image has been transferred passes through a fixing nip portion formed between a fixing roller 18*a* and a pressure roller 18*b* heated to a predetermined temperature in a fixing unit 18, whereby the toner is melted and the toner image is fixed as a fixed image on the recording material S. The toner image is then fixed to the recording material S, and the recording material S is ejected by a discharging roller pair 19 to a discharging tray 17 as an image product.

In each image forming station Y, M, C, and K, the toner remaining on the photosensitive drum 4 without being transferred to the intermediate transfer belt 10*d* at the primary transfer position T1 is collected by a cleaning portion 7. Similarly, the toner remaining on the intermediate transfer belt 10*d* without being transferred to the recording material S at the secondary transfer position T2 is collected by a belt cleaner 13.

[Problems in Exposure Control]

The exposure control in the present embodiment is designed to solve the two problems of "drum ghosting" and "transfer memory" as described below.

(Drum Ghosting)

In the photosensitive drum 4, the portion that has been exposed in the previous process generates a potential difference between the portion that has not been exposed in the previous process in the next charging process due to residual charge in the charge transmission layer and other factors. Therefore, when the photosensitive drum 4 is exposed again, a post-exposure potential difference is generated between the portion that was exposed in the previous process and the portion that was not exposed. In other words, the potential difference between the printed area (exposed area) and the non-printed area (unexposed area) in the previous image formation will remain in the photosensitive drum 4 during the next image formation. If this potential difference becomes large, a density difference (drum ghosting) will occur in the final image formed.

Figure 2:
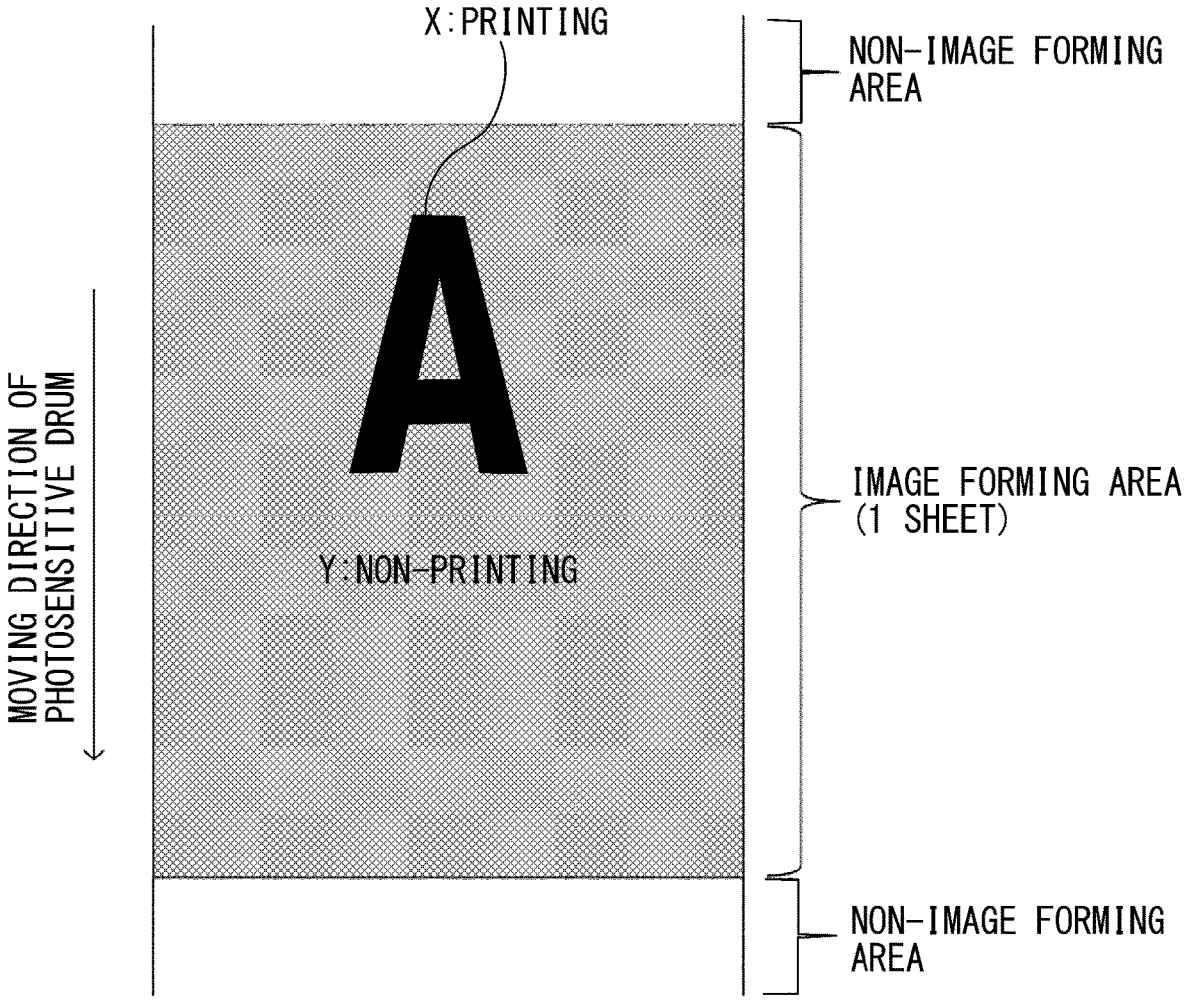
FIG. 2 is a schematic drawing showing the image forming and non-image forming areas on the surface of photosensitive drums in Examples 1 and 2.

To suppress drum ghosting, in the present embodiment, background exposure control is used in the exposure process, which is a minute amount of light emission (second light quantity) that does not cause toner to adhere. Background exposure is explained here using the Figure. FIG. 2 shows how exposure is performed on the photosensitive drum 4 by a laser exposure unit 9. FIG. 2 is a schematic drawing showing the surface of the photosensitive drum 4 on a flat surface, with the surface of the photosensitive drum 4 moving downward (moving direction of the photosensitive drum surface) in the Figure. The surface of the photosensitive drum 4 has an image area (one page of recording material S) where a laser beam L from the laser exposure unit 9 is irradiated to form an electrostatic latent image, and a non-image area where no electrostatic latent image (toner image) is formed. The non-image area corresponds, for example, to the area of the prerotation, paper interval, and back rotation. The paper interval is the interval between the trailing end in the feeding direction of the preceding recording material S and the leading end in the feeding direction of the next recording material S after the preceding recording material S when printing on consecutive recording materials S. In the background exposure control, the following exposure control is performed. That is, when forming the electrostatic latent image shown in FIG. 2 on the surface of the photosensitive drum 4 in response to image information, the laser beam L is irradiated not only to the print portion X where toner is adhered in the image forming portion, but also to the non-printing portion Y where no toner is adhered. As a result, the printing portion X and the non-printing portion Y are both exposed to the laser beam L. This prevents a potential difference from occurring between the printing portion X and the non-printing portion Y, thereby suppressing the occurrence of density differences (drum ghosting).

(Transfer Memory)

When printing color images, the toner image formed on the intermediate transfer belt 10*d* at the image forming station upstream in the moving direction of the intermediate transfer belt 10*d* disturbs the potential of the photosensitive drum 4 at the downstream image forming station. This can cause an image defect called transfer memory. For example, a desired color is formed by superimposing multiple colors of toner, such as yellow and magenta for printing red, magenta and cyan for printing blue, and yellow and cyan for printing green. The red, blue, and green image forming described above is then performed at the yellow, magenta, and cyan image forming stations Y, M, and C, which are upstream from the black image forming station K shown in FIG. 1. Therefore, during image forming at the black image forming station K, the yellow, magenta, and cyan toner images have already been transferred onto the intermediate transfer belt 10*d*. When multiple toner images are superimposed and transferred on the intermediate transfer belt 10*d*, especially when a large amount of toner of multiple colors is superimposed (hereinafter referred to as a multicolor state), the following condition occurs at the primary transfer position T1. In other words, the primary transfer current that flows from a primary transfer roller 11 to the photosensitive drum 4 via the intermediate transfer belt 10*d* becomes very difficult to flow in a multicolor state. Therefore, a large potential difference is generated on the surface potential of the photosensitive drum 4 after passing through the primary transfer position T1 due to the difference in the amount of current of the primary transfer current flowing to the photosensitive drum 4 between the area on the intermediate transfer belt 10*d* in a multicolor state where a large amount of toner of multiple colors is overlapped and the area where no toner exists. Especially in the case of a multicolor state, where a large amount of toner of multiple colors overlaps, the surface potential of the photosensitive drum 4 after passing through the primary transfer position T1 is close to the predetermined potential in the subsequent charging process. As a result, the surface potential of the photosensitive drum 4 may become overcharged to a higher potential than the predetermined post-charging potential.

When the development process is executed with such a potential difference, a difference in the amount of toner transferred from the developing roller 6 to the photosensitive drum 4 occurs according to the potential difference on the surface of the photosensitive drum 4, and the difference in the amount of toner transferred eventually appears as a density difference on the image, resulting in image defects (transfer memory). The background exposure described above is an effective means of suppressing the transfer memory. In the present embodiment, the background exposure always lowers (makes smaller) the surface potential of the photosensitive drum 4 after charging by about 100 V in absolute value, compared to the potential after charging. This ensures a potential difference from the surface potential of the photosensitive drum 4 after charging when the next charging process is executed, and the surface potential of the photosensitive drum 4 after charging can be maintained at a predetermined charging potential.

(Problem of Background Exposure)

However, the background exposure described above, which is performed to suppress drum ghosting and transfer memory, requires the laser beam L from the laser exposure unit 9 to constantly lower the surface potential of the photosensitive drum 4 by about 100V. As a result, the photosensitive drum 4 is always irradiated with a slightly higher intensity of the laser light L. This causes the optical fatigue of the charge transport layer and the underlying charge generation layer of the photosensitive drum 4, which is a problem, especially when aiming for longer product life. Since the sensitivity of the photosensitive drum 4 that has become optical-fatigued is reduced, the potential difference between the required development voltage and the surface potential of the printing portion of the photosensitive drum 4 where the electrostatic latent image is formed (hereinafter referred to as "development contrast") cannot be maintained, which may result in a phenomenon in which the density of the image is reduced. Another problem in extending the service life of the image forming apparatus P is the degradation of the laser element due to the long laser emission time caused by the background exposure. When the laser element deteriorates, the laser beam intensity decreases and sufficient development contrast cannot be secured, resulting in a decrease in the density of the formed image.

Control of the Background Exposure in the Present Embodiment

To solve the above-mentioned problem of background exposure control, the method of reducing the amount of laser light irradiated to the photosensitive drum 4 in the present embodiment is described. Part (a) of FIG. 3 is a schematic drawing showing the printing portion, non-printing portion, and non-image forming portion of the image forming area on the surface of the photosensitive drum 4, developed in the rotational direction of the photosensitive drum 4 (moving direction of the photosensitive drum 4 surface). In part (a) of FIG. 3, the area of the photosensitive drum 4 surface consists of an image forming area where the toner image to be transferred to the intermediate transfer belt 10*d* is formed, and a non-image forming area corresponding to the area of the prerotation and postrotation, and the paper interval, which is the interval between the recording materials. X (black-colored area in the Figure) indicates the printing portion where the electrostatic latent image is formed in the image forming area, and Y1 and Y2 indicate the non-printing portions where the electrostatic latent image is not formed in the image forming area. In detail, the non-printing portion Y1 (the crossed-out hatched portion in the Figure) indicates the non-printing portion in the main scanning direction (left-right direction in the Figure) where the laser beam scans on the photosensitive drum 4 and the background exposure is performed (BG exposure ON) when the area of the printing portion X is present. On the other hand, the non-printing portion Y2 (the hatched portion with diagonal lines in the Figure) represents the non-printing portion in the main scanning direction when there is no printing portion like the printing portion X, and background exposure is not performed (BG exposure OFF). The main scanning direction is also the rotational axis direction of the photosensitive drum 4.

Here, the only area where background exposure is required to suppress the above-mentioned transfer memory is the non-printing portion Y1 where there is a printing portion X in the main scanning direction. As mentioned above, transfer memory is caused by the difference in the amount of current flowing to the photosensitive drum 4 at the primary transfer position T1 between the area on the photosensitive drum 4 where toner is present (printing portion X) and the area where toner is not present (non-printing portion Y1). At the primary transfer position T1, the difference in the amount of current flowing to the photosensitive drum 4 causes a large potential difference in the surface potential of the photosensitive drum 4 after passing through the primary transfer position T1, and this potential difference appears as a density difference on the image. Therefore, when there is no printing portion X in the main scanning direction of the photosensitive drum 4, there is no need to perform background exposure because the transfer memory is not apparent. In other words, by limiting the execution of background exposure to only those non-printing portions of the non-printing portion where a printing portion X exists in the main scanning direction, it is possible to suppress optical degradation of the photosensitive drum while maintaining image quality.

As explained above, in the present embodiment, as shown in part (a) of FIG. 3, background exposure is not performed in the non-printing portion Y2 which is the most downstream in the surface moving direction of the photosensitive drum 4 among the non-printing portions that exist in the image forming portion of the photosensitive drum 4. The position at which the background exposure control is switched to be stopped is determined based on the bitmap data after image data processing as described below.

[Image Data Processing for Exposure Control]

The video controller 100 in the image forming apparatus P in the present embodiment receives a print request signal including image information from the printer controller 200, which makes a print request to the image forming apparatus P. At that time, the printer controller 200 sends commands such as the paper size for image formation, operation mode (single-sided printing, double-sided printing), etc., along with image data as image information. The image data is processed by the video controller 100. If the image data is a color image, the image data is in the form of color information using RGB (red, green, and blue) data. The color information from the respective RGB (red, green, and blue) data is converted by the video controller 100 from device RGB data to device YMCK (yellow, magenta, cyan, and black) data that can be reproduced on the image forming apparatus P. The number of pixels in the image forming apparatus P in the present embodiment is 600 dpi, and the video controller 100 creates bitmap data (image density data for each CMYK color) corresponding to the number of pixels. Then, for each pixel, the exposure amount for each color is converted to the exposure pattern actually used, and the laser beam L corresponding to the image information is output from the laser exposure unit 9.

In the present embodiment, the bitmap data transmitted from the video controller 100 is used as the position information of the rear end of the printing portion in the image forming portion of the photosensitive drum 4. Specifically, the position information of the rear end of the printing portion represents the distance (in pixels) from the leading end of the image forming portion in the sub-scanning direction of the photosensitive drum 4 to the pixel position of the rear end pixel of the printing portion. The laser exposure unit 9 stops the control of the background exposure being performed based on the rear end position information of the printing portion.

Back Contrast with Background Exposure Control in the Present Embodiment

In the present embodiment, the laser intensity irradiated to the area of the printing portion X in the image forming portion is set to 0.320 (μJ/cm), and the laser intensity of the background exposure irradiated to the non-printing portion is set to 0.055 (μJ/cm). Of the non-printing portion areas in the image forming portion, only the non-printing portion Y2, which is the most downstream in the moving direction of the surface of the photosensitive drum 4, is set not to perform background exposure. Specifically, in the case of the image shown in part (a) of FIG. 3, the area of the printing portion X is exposed with a laser intensity of 0.320 (μJ/cm). On the other hand, the non-printing portion Y1 up to the rear end of the printing portion X in the sub-scanning direction (photosensitive drum surface moving direction) of the photosensitive drum 4 is exposed with a laser intensity of 0.055 (μJ/cm), and the non-printing portion Y2 following the rear end of the printing portion X in the sub-scanning direction is not exposed.

Part (b) of FIG. 3 is a graph showing the surface potential of the photosensitive drum 4 at a line L in part (a) of FIG. 3 when the aforementioned exposure control is performed. In part (b) of FIG. 3, the horizontal axis indicates the position of the photosensitive drum 4 in the sub-scanning direction (rotational direction), and Y1, X, and Y2 in the figure indicate the names of areas within the image forming area shown in part (a) of FIG. 3. On the other hand, the vertical axis indicates the surface potential of the photosensitive drum 4 (unit: V).

After being charged by the charging roller 5, the surface potential of the photosensitive drum 4 is charged to about −600 V (post-charge potential), regardless of the position in the sub-scanning direction. Background exposure is performed in the non-printing portion Y1. Therefore, the surface potential of the photosensitive drum 4 after the background exposure is performed by the laser exposure unit 9 has decreased to about −500 V (post-exposure potential). In the present embodiment, the developing voltage is applied at a constant voltage of −350V. Therefore, a back contrast Vback, which is the potential difference between the developing voltage and the surface potential of the non-printing portion Y1 of the photosensitive drum 4, is about 150V (=|−500V|−|−350V|). On the other hand, in the area of the printing portion X, the surface potential of the photosensitive drum 4 is lowered to about −100V by the exposure by the laser exposure unit 9. Therefore, a development contrast Vcont, which is the potential difference between the development voltage required to adhere and develop the toner and the surface potential of the printing portion X of the photosensitive drum 4, is secured to be about 250 V (=|−350 V|−|−100 V|). The non-printing portion Y2 following the rear end of the printing portion X is left at about −600V, which is the surface potential of the photosensitive drum 4 after charging, because background exposure is not performed. Therefore, the back contrast Vback is about 250V (=|−600V|−|−350V|).

Charging Voltage Control in the Present Embodiment

FIG. 4 shows the relationship between the back contrast Vback and the fogging concentration of toner on the photosensitive drum 4. Here, fogging refers to the phenomenon in which toner adheres to non-printing portions due to the developing operation by the developing roller 6, resulting in a higher density. In FIG. 4, the horizontal axis shows the back contrast Vback voltage (unit: V), and the vertical axis shows the toner fogging density, with the fogging density increasing as the vertical axis moves upward and decreasing as the vertical axis moves downward. In FIG. 4, the back contrast Vback has the lowest fog density at 100V, and as it increases from 100V to 150V, 200V, and 250V, the fog density due to reversal fog, in which toner charged with the opposite (positive) polarity is developed, increases. On the other hand, as the back contrast Vback decreases from 100V to 50V, the fog density due to ground fog, where normally (negatively) polarized toner is developed, becomes larger.

When the back contrast Vback increases, reversal fogging, in which toner charged in the reverse polarity (positive polarity) is developed due to poor toner charging, etc., increases. This causes more toner than expected to be consumed and more toner to be collected in the cleaner container by the cleaning portion 7. As a result, the image forming apparatus P may become larger and more costly due to the increased size of the cleaner container.

Therefore, in the present embodiment, background exposure is not performed in the non-printing portion Y2 of the image forming portion, as shown in part (a) of FIG. 3, and charging control is performed to reduce the charging voltage that charges the non-printing portion Y2, as described above. FIG. 5 shows the photosensitive drum surface potential at line L in part (a) of FIG. 3 when the charging voltage is reduced. In FIG. 5, the horizontal axis indicates the position of the photosensitive drum 4 in the sub-scanning direction (rotational direction), and Y1, X, and Y2 in the Figure indicate the names of areas within the image forming area shown in part (a) of FIG. 3. On the other hand, the vertical axis indicates the surface potential of the photosensitive drum 4 (unit: V).

As shown in FIG. 5, the surface potential of the photosensitive drum 4 in the non-printing portion Y1 is −500 V (post-exposure potential) due to the background exposure by the laser exposure unit 9. The surface potential of the photosensitive drum 4 in the printing portion X is about −100 V due to the exposure by the laser exposure unit 9. On the other hand, the surface potential of the photosensitive drum 4 in the non-printing portion Y2 is −600 V (post-charging potential) when background exposure is not performed, as shown in part (b) of FIG. 3. In the present embodiment, however, in the non-printing portion where background exposure is not performed (non-printing portion Y2), the surface potential of the photosensitive drum 4 after charging changes as follows by decreasing the charging voltage by 100V. That is, the surface potential of the photosensitive drum 4 after charging decreases from −600 V to about −500 V, which is the same potential as after background exposure. This ensures that the back contrast Vback in the non-printing portion Y2 is 150V (=−|500V|−|−350V|), the same as in the non-printing portion Y1. As a result, the back contrast Vback in the non-printing portion Y2 is reduced from 250V to 150V, and as shown in the graph in FIG. 4, the increase in toner amount due to reversal fogging can be suppressed.

Effect of the Present Embodiment

Experiments with the control described above were conducted to confirm the effect of reducing the amount of laser exposure to the photosensitive drum 4 and the amount of scraping on the surface of the photosensitive drum 4. In the experiments in the present embodiment, the image forming apparatus P was used to print two consecutive sheets of A4 size (approximately 297 mm in length in the feeding direction) recording materials S, using the image data shown in FIG. 6. FIG. 6 is a schematic drawing of the surface of the photosensitive drum 4 developed in the rotational direction of the photosensitive drum 4 (photosensitive drum surface moving direction), showing the image data used in this experiment. In FIG. 6, the image forming area shows the printing and non-printing portions printed on A4-size recording material S. The non-printing portions are the areas corresponding to the prerotation, paper interval, postrotation, etc.

As shown in FIG. 6, the front half (148.5 mm) of the length of the feeding direction of the A4 size recording material S is occupied by the printing portion X of the image data, and the rear half (148.5 mm) of the length of the feeding direction of the recording material S is occupied by the non-printing portion Y2. The non-printing portion Y1 is located on both end sides in the main scanning direction of the printing portion X. The non-printing portion Y1 is located on both end sides in the main scanning direction of the printing portion X. In this experiment, background exposure is applied to the non-printing portion Y1 (BG exposure ON), and no exposure is applied to the non-printing portion Y2 and the non-image forming portion (BG exposure OFF).

As a result of this experiment, it was confirmed that the amount of laser emission in printing two sheets of recording material S can be reduced to about 28% of the amount of laser emission when the image forming and non-printing portions are always exposed during printing. The exposure control in the present embodiment described above can extend the life of the laser element. In addition, since the amount of laser emission can be reduced, the amount of laser beam received by the photosensitive drum 4 can be reduced as well, and thus the sensitivity reduction of the photosensitive drum 4 can also be suppressed in the same way. It was also confirmed that the amount of surface shaving of the photosensitive drum 4 when a total of 5,000 sheets of recording material S were printed under the printing conditions described above could be reduced to about 18% of the amount of surface shaving of the photosensitive drum 4 when the image forming and non-printing portions of the drum are constantly exposed during printing.

In this experiment, the charging voltage was reduced by 100 V for the non-printing portion Y2, and background exposure was not performed as in the non-printing portion Y1, but the following exposure control may be used, for example. In other words, for the non-printing portion Y2, the charging voltage may remain at the predetermined range, and a background exposure with a reduced exposure amount (by the third light quantity) may be performed compared to the background exposure for the non-printing portion Y1. In such a case, the back contrast Vback described above becomes larger than that for the non-printing portion Y1 by lowering the exposure amount, but the exposure amount should be such that the potential difference is such that the increase in toner volume due to reversal fogging is guaranteed to be suppressed.

As explained above, the exposure control and charging control in the present embodiment described above can reduce the amount of laser light exposure to the photosensitive drum 4 while maintaining image quality by suppressing the occurrence of drum ghosting, transfer memory, and toner fogging. This can have the effect of suppressing sensitivity degradation, charge potential attenuation, and laser element deterioration due to photo fatigue of the photosensitive drum 4, as well as surface shaving of the photosensitive drum 4, which is a problem for the long life of the product.

In the present embodiment, the background exposure is not performed in the non-printing portion Y2 when there is no printing area in the main scanning direction of the photosensitive drum 4, thereby suppressing optical fatigue of the photosensitive drum. The same effect can also be achieved by the method of performing background exposure with a reduced exposure amount compared to the non-printing portion Y1, while maintaining the predetermined range of charging voltage described above. The method of reducing the exposure amount may be, for example, by adjusting the laser output or by adjusting the exposure time.

As explained above, according to the present embodiment, the amount of exposure to the photosensitive member can be reduced while maintaining image quality.

In Embodiment 1, we described an example in which background exposure is not performed in the non-printing portion of the image forming area, which is the most downstream non-printing portion in the sub-scanning direction, and in which only switching control of the charging voltage is performed. In Embodiment 1, there was only one non-printing portion in which the switching control of the charging voltage was performed at most. Embodiment 2 describes an example in which the charging voltage switching control is performed without background exposure in all of the multiple non-printing portions in the image forming area, except for the non-printing portions that satisfy the predetermined range of conditions. The image forming apparatus to which Embodiment 2 is applied is the same as the image forming apparatus P of Embodiment 1, and the same codes as in Embodiment 1 are used for the same devices and members, and detailed descriptions are omitted.

Exposure Control and Charging Voltage Control in the Present Embodiment

In Embodiment 2, when the exposure and charging positions on the photosensitive drum 4 are moved from the non-printing portion of the photosensitive drum 4 where a printing area exists in the main scanning direction to the non-printing portion where no printing area exists in the main scanning direction, the following control is performed. In other words, a switching control of the background exposure from the ON state to the OFF state and a switching control of the charging voltage to lower the charging voltage are implemented. The switching control of background exposure from the ON state to the OFF state is performed by switching the laser element that emits the laser beam from the ON state to the OFF state, so the emission of the laser beam is immediately stopped. On the other hand, regarding the switching of the charging voltage, the output charging voltage is not switched immediately, but the charging voltage changes relatively slowly.

FIG. 7 is a drawing of the changes in the surface potential of the photosensitive drum 4 when exposure control and charging voltage control are applied to the non-printing portion Y1, where a printing area exists in the main scanning direction, and to the non-printing portion Y2, where no printing area exists in the main scanning direction. In FIG. 7, the horizontal axis shows the position of the photosensitive drum 4 in the sub-scanning direction (rotational direction of the photosensitive drum 4), and the vertical axis shows the surface potential of the photosensitive drum 4 (unit: V). In FIG. 7, −600V is the voltage after the charging process (post-charging potential) (indicated by the dotted line in the Figure), −500V is the voltage when background exposure is performed (post-exposure potential), and −350V is the development voltage applied to the developing roller 6.

Here, the charging voltage switching control is performed to lower the charging voltage at the timing when the non-printing portion Y2 on the photosensitive drum 4 moves to the charging position where the charging voltage is applied. The background exposure is switched from the ON state to the OFF state at the timing when the non-printing portion Y2 on the photosensitive drum 4 moves to the exposure position where the laser beam from the laser exposure unit 9 is irradiated. When the switching control of the charging voltage and the background exposure is performed at such timing, the surface potential of the photosensitive drum 4 changes as shown in FIG. 7. As mentioned above, the charging voltage does not switch immediately like the laser element of the laser exposure unit 9, but falls slowly. Therefore, the surface potential of the photosensitive drum 4 temporarily rises to −600 V at the timing when the background exposure is switched from the ON state to the OFF state.

As the charging voltage falls from −600V to −500V, the surface potential of the photosensitive drum 4 converges to −500V. In other words, if the background exposure is switched from the ON state to the OFF state and the charging voltage control to lower the charging voltage is performed at the timing when the exposure and charging positions move from the non-printing portion Y1 to the non-printing portion Y2, the back contrast Vback is temporarily increased. Therefore, during the period when the surface potential of the photosensitive drum 4 decreases from −600 V to −500 V, the back contrast Vback becomes larger, resulting in an increase in the amount of toner in the reversal fog, as shown in FIG. 4. However, since this phenomenon is only for a temporary period when the charging voltage is switched, the amount of toner collected by the cleaning portion 7 is small.

In the present embodiment, when the exposure and charging positions on the photosensitive drum 4 are moved from the area of the non-printing portion where no printing area exists in the main scanning direction of the photosensitive drum 4 to the non-printing portion where a printing area exists in the main scanning direction, the following controls are performed. In other words, the switching control of the background exposure from the OFF state to the ON state and the switching control of the charging voltage that increases the charging voltage are implemented. Part (a) of FIG. 8 shows the change in the surface potential of the photosensitive drum 4 when exposure control and charging voltage control are applied to the non-printing portion Y2, where no printing area exists in the main scanning direction, and to the non-printing portion Y1, where a printing area exists in the main scanning direction. In part (a) of FIG. 8, the horizontal axis shows the position of the photosensitive drum 4 in the sub-scanning direction (rotational direction of the photosensitive drum 4), and the vertical axis shows the surface potential of the photosensitive drum 4 (unit: V).

Here, the charging voltage switching control is performed to increase the charging voltage at the timing when the non-printing portion Y1 on the photosensitive drum 4 moves to the charging position where the charging voltage is applied. The background exposure is switched from the OFF state to the ON state at the timing when the non-printing portion Y1 on the photosensitive drum 4 moves to the exposure position where the laser beam from the laser exposure unit 9 is irradiated. When the switching control of the charging voltage and the background exposure is performed at such timing, the surface potential of the photosensitive drum 4 changes as shown in part (a) of FIG. 8. The charging voltage does not switch immediately like the laser element of the laser exposure unit 9, but rises slowly. Therefore, at the timing when the background exposure is switched from the OFF state to the ON state, the surface potential of the photosensitive drum 4 temporarily drops to −400V. Then, as the charging voltage rises from −500V to −600V, the surface potential of the photosensitive drum 4 converges to −500V. Therefore, during the period when the surface potential of the photosensitive drum 4 rises from −400V to −500V, the back contrast Vback becomes small, which, as shown in FIG. 4, results in an increase in the amount of ground foggy toner that is developed by the regular (negative polarity) charged toner. Since the toner of ground fog developed on the photosensitive drum 4 is mainly negatively charged toner, it may be transferred to the intermediate transfer belt 10*d* and further transferred to the recording material P, which may manifest as an image defect.

Therefore, in the present embodiment, the charging voltage switching control that raises the charging voltage is performed at a timing earlier than when the non-printing portion Y1 on the photosensitive drum 4 moves to the charging position where the charging voltage is applied. This suppresses the increase in the amount of toner in the ground fogging described above. The specific method is explained using part (b) of FIG. 8. Part (b) of FIG. 8 is a drawing showing the switching timing of the charging voltage in the present embodiment, and the configuration of the figure is the same as that of part (a) of FIG. 8, except that the graph of the surface potential of the photosensitive drum 4 is different from that shown in part (a) of FIG. 8, and the explanation of how to view the figure is omitted. Compared to the conventional switching timing of the charging voltage shown in part (a) of FIG. 8, the switching control of the charging voltage in part (b) of FIG. 8 starts 100 msec (milliseconds) earlier than the switching timing of the switching control of the background exposure. By starting the switching control of the charging voltage earlier than the switching timing of the background exposure, the back contrast Vback conversely becomes larger. However, the period during which the back contrast Vback becomes large is temporary, and the amount of toner collected by the cleaning portion 7 is small, so the occurrence of ground fog can be suppressed.

In addition, as mentioned above, when the charging voltage is switched, the change in voltage is relatively gradual until the charging voltage converges to the switched voltage. Therefore, if the printing portion X and non-printing portions Y1 and Y2 exist repeatedly at short intervals in the sub-scanning direction of the photosensitive drum 4, the target area to which the charging voltage is applied will change before the charging voltage converges to the voltage after the switching, and the charging voltage will not be switched in time. Therefore, in the present embodiment, considering the time required for the charging voltage to converge to the voltage after the switching, the control portion for the non-printing portion Y2 is as follows when there is a non-printing portion Y2 between the printing portion X and the printing portion X in the sub-scanning direction of the photosensitive drum 4.

In other words, if the length in the sub-scanning direction of the non-printing portion Y2 is shorter than the length that the surface of the photosensitive drum 4 can move in 200 msec (milliseconds) (=0.2 seconds), the switching of the charging voltage should be stopped and background exposure control should be performed as in the non-printing portion Y1. The surface moving speed of the photosensitive drum 4 (which is also the rotation speed of the photosensitive drum 4) in the present embodiment is 150 mm/sec (sec). Therefore, the non-printing portion Y2 whose length in the sub-scanning direction is shorter than 30 mm (=150 mm/sec×0.2 sec) corresponds to the area where background exposure control is performed.

Effect of the Present Embodiment

Experiments with the control described above were conducted to confirm the effect of reducing the amount of laser exposure irradiated to the photosensitive drum 4 and the amount of surface shaving of the photosensitive drum 4. In the present embodiment, Embodiment 2, experiments were conducted using the image forming apparatus P to print two consecutive sheets of A4 size (approximately 297 mm in feeding direction length) recording material S, using the image data shown in part (a) of FIG. 9. Part (a) of FIG. 9 shows the image data used in this experiment in a schematic drawing of the surface of the photosensitive drum 4 developed in the rotational direction of the photosensitive drum 4 (the photosensitive drum surface moving direction). In part (a) of FIG. 9, the image forming area shows the printing area and non-printing area (the unit of the numerical values in the figure is mm) printed on A4 size recording material S. The non-printing area is the area corresponding to the prerotation, paper interval, postrotation, and so on.

As shown in part (a) of FIG. 9, there are three areas of printing portions X. The length of each printing portion X in the sub-scanning direction is 26 mm, 10 mm, and 10 mm, in order from the top printing portion X in the Figure. In between each printing portion X area in the sub-scanning direction, there is a non-printing portion Y2 that does not have a printing portion X in the main scanning direction. The lengths of each non-printing portion Y2 in the sub-scanning direction are 10 mm and 238 mm, starting from the non-printing portion Y2 on the upper side of the Figure, in that order. The sub-scanning direction length of the non-printing portion Y2 on the upper side of the Figure is 10 mm, which is shorter than the sub-scanning direction length of 30 mm that allows switching of the charging voltage described above, so background exposure (BG exposure ON) is performed as in the non-printing portion Y1. On the other hand, the length of the non-printing portion Y2 on the lower side of the Figure in the sub-scanning direction is 238 mm, which is longer than the 30 mm length in the sub-scanning direction where the charging voltage can be switched, so background exposure is not performed (BG exposure OFF) and the charging voltage is switched (charging voltage control to lower the charging voltage). Background exposure (BG exposure ON) is performed for the non-printing portion Y1 where the printing portion X is provided in the main scanning direction. For the non-image forming area, the control is such that no exposure is performed.

As a result of this experiment, it was confirmed that the amount of laser emission in printing two sheets of recording material S can be reduced to about 7% of the amount of laser emission when the image forming area and non-printing portion of the printing are always exposed during printing. The exposure control in the present embodiment described above can extend the life of the laser element. In addition, since the amount of laser light received by the photosensitive drum 4 can be similarly reduced by decreasing the amount of laser light emitted, the sensitivity reduction of the photosensitive drum 4 can also be suppressed in the same way. It was also confirmed that the amount of surface shaving of the photosensitive drum 4 when a total of 5,000 sheets of recording material S were printed under the printing conditions described above could be reduced to about 21% of the amount of surface shaving of the photosensitive drum 4 when the image forming area and non-printing portion during printing are constantly exposed.

In Embodiment 2, as in Embodiment 1, the charging voltage was reduced by 100 V for the non-printing portion Y2, and background exposure was not performed as in the non-printing portion Y1. For example, in Embodiment 2, the charging voltage may remain at the predetermined range for the non-printing portion Y2, and a background exposure with a lower exposure amount than the background exposure for the non-printing portion Y1 may be performed. In this case, the back contrast Vback described above will be larger than for the non-printing portion Y1 by lowering the exposure amount, but the exposure amount should be such that the potential difference is sufficient to ensure that the increase in toner volume due to reversal fogging is suppressed.

As explained above, the exposure control and charging control in the present embodiment described above can reduce the amount of laser light exposed to the photosensitive drum 4 while maintaining image quality by suppressing the occurrence of drum ghosting, transfer memory, and toner fogging. This can have the effect of suppressing the problems of product longevity, such as sensitivity reduction due to optical fatigue of the photosensitive drum 4, charge potential attenuation, deterioration of the laser element, and even surface shaving of the photosensitive drum 4. The same effect can also be achieved by the method of background exposure with a reduced amount of exposure compared to the non-printing portion of the non-printing portion Y1, while maintaining the predetermined range of charging voltage as described above.

Although the preferred embodiments of the present invention have been described above, the invention is not limited to these embodiments, and the following variations and changes are possible.

In the aforementioned embodiments, when switching the charging voltage, the rise and fall of the charging voltage is gradual compared to a laser device that outputs a laser beam from the laser exposure unit 9, and it takes time for the voltage to converge to the voltage after the switch. Therefore, the back contrast Vback temporarily increases. Since the increase in back contrast Vback is temporary, the amount of toner collected by cleaning portion 7 is small. However, in order to reduce the amount of toner of reversal fog as much as possible, the laser output from the laser exposure unit 9 or the exposure time of the laser beam is changed in steps according to the changes in the rising and falling voltages of the charging voltage. This allows the amount of laser light irradiated to the photosensitive drum 4 to be reduced while keeping the back contrast Vback constant, thereby suppressing the increase in the amount of toner of reversal fogging.

In Embodiment 2 above, in the non-printing portion Y2 where background exposure is not performed, the control to maintain the back contrast Vback was performed by keeping the developing voltage constant and decreasing the charging voltage. For example, the same effect can be achieved by controlling to maintain the back contrast Vback by keeping the charging voltage constant and increasing the developing voltage. In this case, the voltage change at the rise and fall of the developing voltage when switching the developing voltage is also relatively gradual, as is the charging voltage. Therefore, it is necessary to control the back contrast Vback so that it does not become temporarily small and the development contrast Vcont does not change. In particular, since the developing contrast Vcont is likely to affect image density and line width as it changes, it is necessary to switch the laser output of the laser exposure unit 9 in stages in accordance with changes in the rising and falling development voltage.

As explained above, according to the present embodiment, the amount of exposure to the photosensitive member can be reduced while maintaining image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-161022 filed on Sep. 30, 2021, which is hereby incorporated by reference herein in its entirety.

What is claimed is:

1. An image forming apparatus comprising:

a rotatable photosensitive member;

a charging member configured to charge a surface of the photosensitive member;

an exposing unit configured to form an electrostatic latent image by exposing the surface of the photosensitive member charged by the charging member to light;

a developing member configured to develop the electrostatic latent image with toner;

a power supplying portion configured to apply a charging voltage to the charging member; and a controller configured to control the exposing unit and the power supplying portion, wherein, of an area of the photosensitive member corresponding to a recording material on which image forming is to be performed, the controller controls so that light is emitted by a first light quantity to a print area, of the photosensitive member, on which the electrostatic latent image is to be developed with the toner, and the light is emitted by a second light quantity lower than the first light quantity to a non-print area on which the electrostatic latent image is not to be formed, and wherein the controller controls so that a predetermined charging voltage is charged and the light is emitted by the second light quantity to a first non-print area, which is a non-print area provided in a region including the print area and the first non-print area with respect to a main scanning direction, which is a rotational axis direction of the photosensitive member, and controls so that a charging voltage, which is of the same polarity as that of the predetermined charging voltage and of which an absolute value is lower than the absolute value of the predetermined voltage, is charged and exposure is not performed on a second non-print area, which is provided in a region including only the second non-print area with respect to the main scanning direction of the photosensitive member.

2. An image forming apparatus according to claim 1, wherein the controller controls so that the charging voltage which is of the same polarity as that of the predetermined charging voltage and of which the absolute value is lower than the absolute value of the predetermined voltage is charged to a most downstream second non-print area with respect to a sub scanning direction, which is a rotational direction of the photosensitive member.

3. An image forming apparatus according to claim 1, wherein in a case in which the charging voltage is switched to the predetermined voltage in order to charge a region including the print area from the second non-print area, the controller controls to switch the charging voltage to the predetermined charging voltage earlier than a timing when the region including the print area reaches a charging position to be charged.

4. An image forming apparatus according to claim 3, wherein the controller controls the timing of when the charging voltage is switched to the predetermined charging voltage to be a timing when the charging voltage is converged to the predetermined charging voltage when the region including the print area has reached the charging position.

5. An image forming apparatus according to claim 3, wherein the controller controls so that the predetermined charging voltage is charged and the light is emitted by the second light quantity to the second non-print area, of which a length in the sub scanning direction, which is a rotational direction of the photosensitive member, is shorter than a predetermined length.

6. An image forming apparatus according to claim 5, wherein the predetermined length is determined based on a rotational speed of the photosensitive member and a time from when the charging member changes the charging voltage from a voltage lower than the predetermined charging voltage to the predetermined charging voltage to when the charging voltage is converged to the predetermined charging voltage.

7. An image forming apparatus according to claim 2, wherein the most downstream second non-print area is determined based on a pixel position, with respect to the sub scanning direction, of a pixel of a trailing end in a most downstream print area in the sub scanning direction of the print area exposed by the exposing unit.

8. An image forming apparatus comprising:

a rotatable photosensitive member;

a charging member configured to charge a surface of the photosensitive member;

an exposing unit configured to form an electrostatic latent image by exposing the surface of the photosensitive member charged by the charging member to light;

a developing member configured to develop the electrostatic latent image with toner;

a power supplying portion configured to apply a charging voltage to the charging member; and a controller configured to control the exposing unit and the power supplying portion, wherein, of an area of the photosensitive member corresponding to a recording material on which image forming is to be performed, the controller controls so that light is emitted by a first light quantity to a print area, of the photosensitive member, on which the electrostatic latent image is to be developed with the toner, and the light is emitted by a second light quantity lower than the first light quantity to a non-print area on which the electrostatic latent image is not to be formed, and wherein the controller controls so that a predetermined charging voltage is charged and the light is emitted by the second light quantity to a first non-print area, which is a non-print area provided in a region including the print area and the first non-print area with respect to a main scanning direction, which is a rotational axis direction of the photosensitive member, and controls so that the predetermined charging voltage is charged and the light is emitted by a third light quantity lower than the second light quantity to a second non-print area, which is provided in a region including only the second non-print area with respect to the main scanning direction of the photosensitive member.

9. An image forming apparatus according to claim 8, wherein the controller controls so that the light is emitted by the third light quantity to a most downstream second non-print area with respect to a sub scanning direction, which is a rotational direction of the photosensitive member.

10. An image forming apparatus according to claim 9, wherein the most downstream second non-print area is determined based on a pixel position, with respect to the sub scanning direction, of a pixel of a trailing end in a most downstream print area in the sub scanning direction of the print area exposed by the exposing unit.

* * * * *